US007054574B2

(12) United States Patent
Facci et al.

(10) Patent No.: US 7,054,574 B2
(45) Date of Patent: May 30, 2006

(54) METHOD FOR CHARGING A PHOTORECEPTOR TO EXTEND THE LIFE OF A CHARGE RECEPTOR IN A XEROGRAPHIC PRINTER

(75) Inventors: John S. Facci, Webster, NY (US); Rachael L. McGrath, Churchville, NY (US)

(73) Assignee: Xerox Corporation, Stamford, CT (US)

( * ) Notice: Subject to any disclaimer, the term of this patent is extended or adjusted under 35 U.S.C. 154(b) by 50 days.

(21) Appl. No.: 10/721,852

(22) Filed: Nov. 25, 2003

(65) Prior Publication Data

US 2005/0111868 A1 May 26, 2005

(51) Int. Cl.
*G03G 15/00* (2006.01)

(52) U.S. Cl. ..... 399/89; 399/50

(58) Field of Classification Search ..... 399/89, 399/50, 170, 168

See application file for complete search history.

(56) References Cited

U.S. PATENT DOCUMENTS 5,543,900 A 8/1996 Maebashi et al. ..... 355/219
5,596,393 A * 1/1997 Kobayashi et al. ..... 399/174
5,613,173 A 3/1997 Kunzmann et al. ..... 399/89

FOREIGN PATENT DOCUMENTS

JP 07308064 A * 11/1995

* cited by examiner

*Primary Examiner*—Quana Grainger
(74) *Attorney, Agent, or Firm*—Lloyd F. Bean, II

(57) ABSTRACT

A method of operating an electrostatographic printing apparatus, the apparatus including a charge-retentive member defining an imaging surface and a charging device for placing a charge on the imaging surface, including the steps of: providing a power supply to apply a bias to the bias charging roll; and applying a bias to the bias charging roll, the applying includes applying a burst modulated waveform to the bias charging roll.

8 Claims, 6 Drawing Sheets

FIG. 6

| Burst Rate | Carrier Frequency | Line | Halftone Uniformity | Photo & Text | |
|---|---|---|---|---|---|
| 1.6 kHz Normal Sine (Control) | | O | O | O | |
| 1.6 kHz | 2.0 kHz | O | O | O | Constant Burst Rate |
| 1.6 kHz | 2.4 kHz | O | O | O | |
| 1.6 kHz | 3.2 kHz | O | O | O | |
| 1.6 kHz | 4.8 kHz | X | X | X | |
| 1.3 kHz | 1.6 kHz | O | O | O | Constant Carrier Frequency |
| 1.0 kHz | 1.6 kHz | O | O | O | |

O – Acceptable X – Poor

METHOD FOR CHARGING A PHOTORECEPTOR TO EXTEND THE LIFE OF A CHARGE RECEPTOR IN A XEROGRAPHIC PRINTER

FIELD OF THE INVENTION

The present invention relates to xerographic printing apparatus, and in particular relates to a system and method for extending the useful life of a charge receptor, such as a photoreceptor used in such apparatus.

BACKGROUND

Electrostatographic printing methods, such as xerography, involve creation of an electrostatic latent image on a charge receptor, such as a photoreceptor. As is well known, in such apparatus, the photoreceptor is imagewise discharged in a manner conforming to an image desired to be copied or printed, and then this latent image is developed with toner. The developed toner image is in turn transferred to a print sheet, which is then fused to fix the transferred toner image thereon.

Charging involves contact charging of a photoreceptor by a bias charge roll (BCR). Its main advantage is its low footprint. Thus it is particularly suited for charging small diameter organic photoconductive drums used in low and mid-volume B/W and color machines. Conventional BCR charging is based on a DC-offset AC excitation waveform. As a result a stable V-hi controlled by the DC bias is achieved when Vpp, the AC peak to peak voltage, is greater than a threshold voltage, V-th. Print quality considerations such as background disappearance and halftone uniformity require Vpp and $I_{AC}$ somewhat greater than the threshold values. Moreover, the trend toward increasing process speed in organic photoconductive drum based machines particularly in tandem color applications leads to even higher AC current requirements.

As is well established, the main drawback of conventional AC BCR charging is the significant limitation it imposes on photoreceptor life because degradative AC corona species are generated in close proximity to the photoreceptor surface. Significant work has been done to extend photoreceptor life such as the development of hard photoreceptor overcoats and corona resistant charge transport layer material (e.g. PTFE filled charge transport layers as well as a variety of excitation waveforms such as DC, clipped AC or pulsed bias waveforms, each with varying degrees of success. DC BCR charging is a very effective means of improving wear life, but BCR sensitivity to contamination by toner and photoreceptor degradation products generally precludes its practical use Pulsed bias and clipped AC excitation waveforms have been shown to greatly improve photoreceptor wear life but a stable V-hi cannot be attained with the latter. Instead V-hi increases monotonically as V-pp and $I_{AC}$ increases. Thus practical implementation would require complex controls to achieve V-hi stability especially across environmental conditions, and may be difficult to achieve.

As hereinbefore discussed, the properties of the charge receptor, such as a photoreceptor, are clearly very important to the overall functioning of a printing apparatus, and to the ultimate quality of images created therewith. The electrical stresses placed on a photoreceptor, with the printing of thousands of images therewith contributes to the degradation of the photoreceptor. As the photoreceptor degrades the quality of images that can be created therewith degrades as well. Thus, in practical embodiments of xerographic printers and copiers, it is inevitable that the photoreceptor will have to be periodically replaced. Replacement of the photoreceptor represents a large expense. It is therefore desirable to provide a method and system by which the photoreceptor, even a pre-existing photoreceptor, can be extended significantly.

DESCRIPTION OF THE PRIOR ART

In the prior art, U.S. Pat. No. 5,543,900 and U.S. Pat. No. 5,613,173 disclose a novel type of charging apparatus for use in charging the photoreceptor in a xerographic printer. In combination with the bias roll which initially charges the photoreceptor is a special "clipping" circuit comprising a diode and resistor. The clipping circuit has the function of clipping an oscillating voltage applied to the bias roll, and in turn to the photoreceptor, as the bias roll charges the photoreceptor. The long-term effect of this clipping is that lesser electrical stresses are experienced by the photoreceptor with extended use, and in turn the degradation of the photoreceptor is slowed down.

SUMMARY OF THE INVENTION

Applicants have found that AC current is a key contributor to photoreceptor wear. Our approach to improving photoreceptor life has been to decrease AC current, not by reducing Vpp, but by reducing the AC duty cycle ("on time"). We propose the use of a "burst modulated" waveform for BCR charging, i.e. a DC offset AC waveform, in which an AC waveform of frequency F1 is gated on and off at a second frequency F2, the burst frequency. Note that only the AC part of the waveform is gated off. The DC bias is maintained at all times. As a result a stable V-hi (independent of Vpp and $I_{AC}$) and the ability to set V-hi via the DC bias is achieved. The effect of decreasing duty cycle on print quality and the corresponding charging characteristics have been studied and we have found that reasonable selection of the AC frequency and the gating frequency allows one to improve photoreceptor wear while maintaining good print quality characteristics such as good halftone uniformity and acceptably low background.

BRIEF DESCRIPTION OF THE DRAWINGS

FIG. 6 shows a tabulated summary of several print quality characteristics obtained in a DC12 machine with several burst modulated excitation waveforms applied to a BCR.

DETAILED DESCRIPTION OF THE INVENTION

Figure 1:
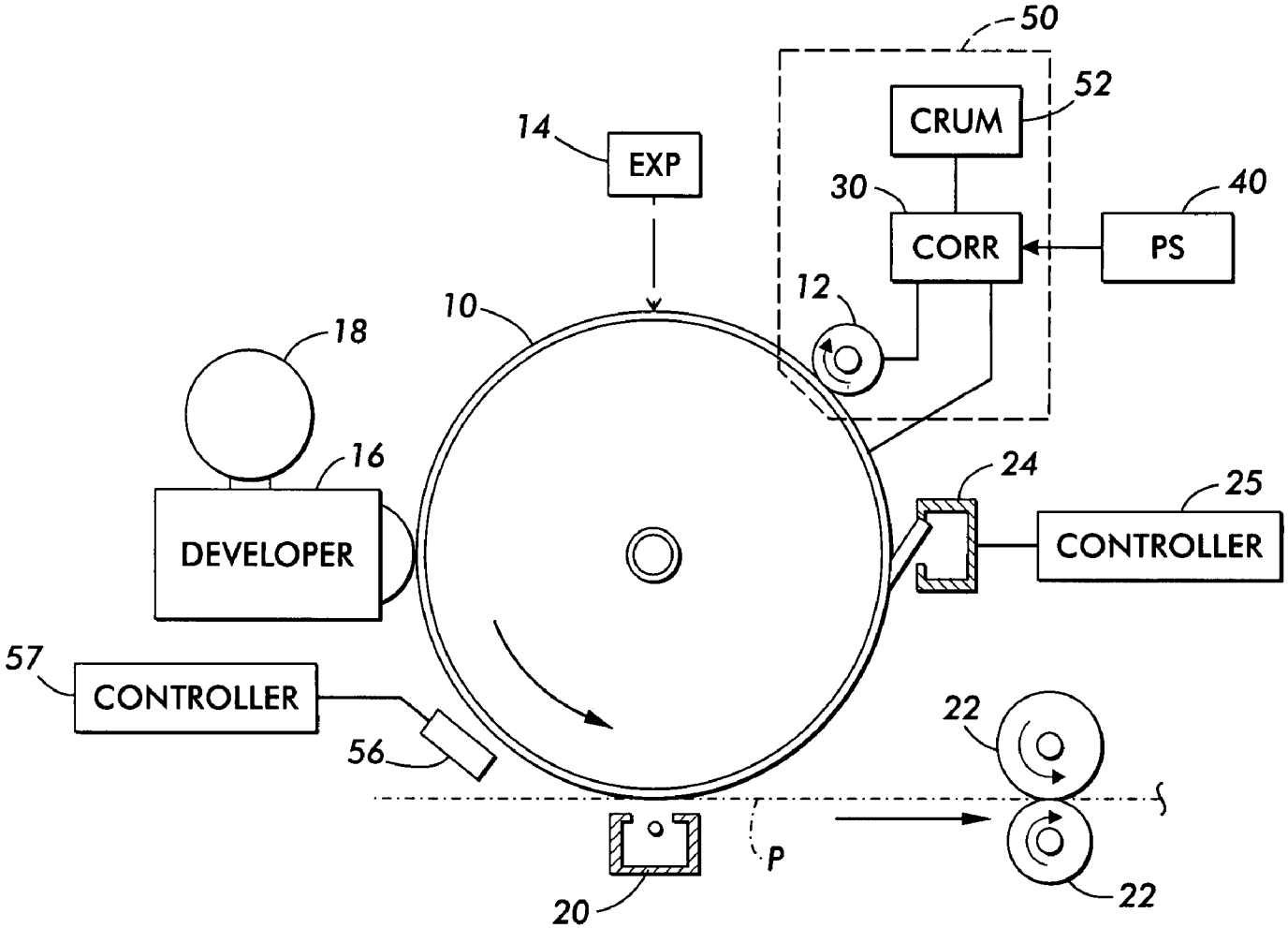
FIG. 1 is a simplified elevational view of the essential elements of a xerographic printer incorporating the present invention.

FIG. 1 is a simplified elevational view of the essential elements of a xerographic printing apparatus. As is well known in the art of xerography, a printing apparatus includes a rotatable photoreceptor 10, here in the form of a rotating drum, around the circumference of which are the various stations with which a series of images desired to be printed are created. Initially, a surface of the photoreceptor 10 is charged by charging device here indicated as 12. In various embodiments of printing apparatus, this charging device 12 can be in the form of a corotron, or other ion-generating device, but in this particular embodiment is in the form of a "bias charge roll" or BCR. The BCR 12 contacts or rolls against a surface of photoreceptor 10 along the length thereof, and places a uniform charge of predetermined magnitude on the surface of photoreceptor 10. After the surface of photoreceptor 10 has been uniformly charged, the surface is imagewise discharged by an exposure device here generally illustrated as 14. As is well known, such exposure devices typically include a scanning laser which is modulated in accordance with digital data, but other exposure devices include an LED array, ion source, or a lens arrangement for exposure of the photoreceptor 10 by a hard copy original image, such as in an analog copier.

Following exposure of the photoreceptor 10, the imagewise areas on photoreceptor 10 which are charged in a particular manner (such as charged to a certain polarity, or discharged, depending on the design of the apparatus) are developed by development unit 16. Typically, development unit 16 includes therein a supply of toner 18, which may be admixed with carrier, as is well known in the art. Following development of the image on photoreceptor 10, the developed image is transferred onto a print sheet, moving in the process direction indicated as capital P, at a transfer station here indicated as 20. The transfer station typically places a predetermined charge on the photoreceptor as the photoreceptor area is contacted by a print sheet, so that toner which has been placed on the photoreceptor is transferred to the print sheet.

The print sheet is then passed through a fuser indicated as 22, of any common design known in the art, which causes the toner image to be permanently fused onto the sheet. Finally, any toner that remains on the surface of photoreceptor 10 following the transfer step is scraped or otherwise removed from photoreceptor 10 by cleaning device 24.

With particular reference to the present invention, there is provided, associated with a charging device such as BCR 12, what is here called a "correction" circuit indicated as 30, which is operatively interposed between the BCR 12 and a power supply 40 (of course, the power supply 40 can serve other sub-systems within the apparatus as well). The intended behavior of the correction circuit 30 is generally to reduce the peak voltage of an AC component of a bias placed on the BCR 12 by power supply 40. As described generally in U.S. Pat. No. 5,613,173, the advantage of this "clipping" of the peak voltage of the AC component is that it causes the photoreceptor 10 to experience less electrical stresses, such as of rapid charging and discharging, which has been shown to contribute to the degradation of the electrical properties of the photoreceptor 10. In brief, by reducing these electrical stresses, the useful life of a photoreceptor 10 can be extended.

Figure 2A:
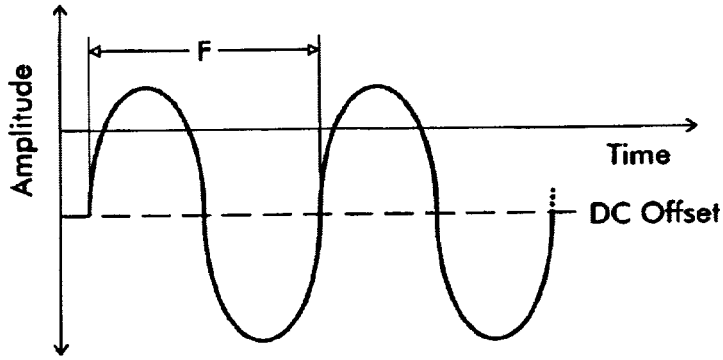
FIG. 2A shows the conventional AC BCR excitation as used in our BCR print tests.
Figure 2B:
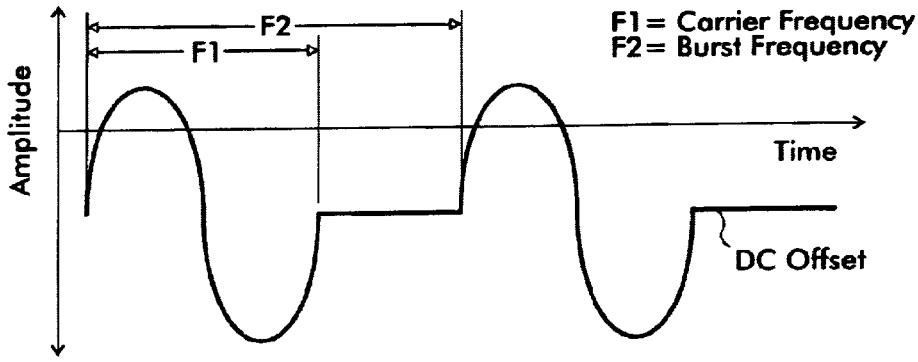
FIG. 2B shows the burst modulated excitation waveform as used in our BCR print tests.

FIG. 2A shows the conventional AC BCR excitation as used in our BCR print tests in a DC12 machine (cyclic color engine, process speed 220 mm/sec, 48 ppm). In B-zone, the DC offset is −570 V, Vpp=2.0 kV, $I_{AC}$=3.5 mA and F=1.6 kHz. FIG. 1B shows the proposed burst modulated waveform. Superimposed on a DC bias is an AC waveform at a carrier frequency F1 (period T1) that is gated on and off at a second frequency F2 (and period T2), the burst frequency. The ratio of AC on time T1=1/F1 to the burst period T2=1/F2 is defined as the AC duty cycle. Any number of cycles of the AC waveform may be present. The key feature of the waveform is that the AC waveform is gated off while maintaining the DC bias, during which time the AC current is zero. As a result the average AC current is decreased relative to conventional BCR charging in which the AC waveform is always on.

Figure 3A:
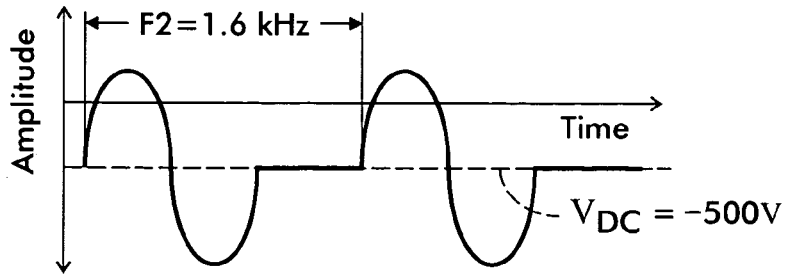
FIG. 3A shows a schematic representation of a particular burst modulation waveform used in BCR testing wherein the burst modulation frequency is fixed at 1.6 kHz and the DC offset is −500 V.
Figure 3B:
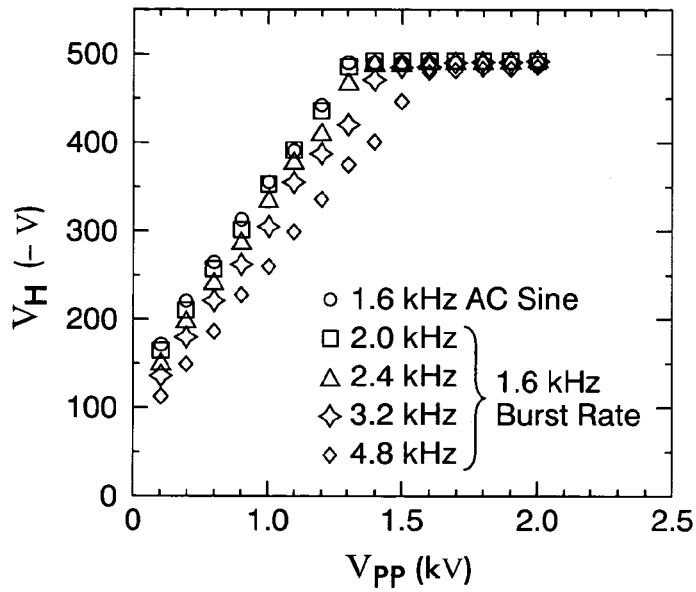
FIG. 3B shows the Vhi-Vpp and Vhi-IAC characteristics for conventional and burst modulated BCR charging wherein the AC duty cycle is varied by Method 1.
Figure 3C:
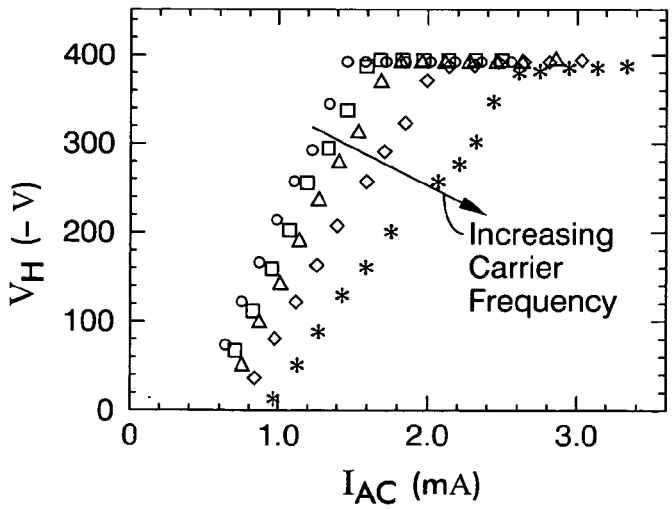

FIG. 3 shows the Vhi-Vpp and Vhi-IAC characteristics for conventional and burst modulated BCR charging. The filled circles in FIGS. 3A and 3B depict conventional BCR charging and the characteristic increase in V-hi with Vpp and IAC, respectively, followed by a leveling off of V-hi above a threshold peak to peak voltage V-th. BCR charging can be done in principle at any Vpp on the plateau of the curve. However, working at a Vpp somewhat greater than V-th is typically required to eliminate background and improve halftone uniformity. This point is known as the background disappearance point. For example, the Tokai-2bb BCR has a background disappearing point that is 20–30% higher than V-th.

Two methods were used to vary the AC duty cycle and characterize burst modulated BCR charging. Method 1 fixes the burst rate F2 and varies the carrier frequency F1. Conversely Method 2 fixes the carrier frequency and varies the burst rate. Electrical results from Method 1 are illustrated in FIG. 3. The open symbols in FIGS. 3A and 3B show the burst modulation charging results when the burst frequency F2 is fixed at 1.6 kHz and the carrier frequency F1 is varied from 2.0–4.8 kHz. At high duty cycle (e.g., F1=2.0 kHz) the charging behavior approaches that of conventional AC charging. As the carrier frequency increases and duty cycle decreases the charging behavior becomes increasingly non-ideal. At high carrier frequency, e.g. at 4.8 kHz, the charge relaxation time of the BCR limits charging efficiency and a stable V-hi becomes difficult to achieve as indicated in FIGS. 3A and 3B. Moreover, print quality becomes very poor; high background results from the inability to charge to V-hi. The use of too high a carrier frequency to achieve low AC duty cycle must be avoided for these reasons. A practical carrier frequency upper limit for the BCR is about 2.4–3.2 kHz.

Figure 4A:
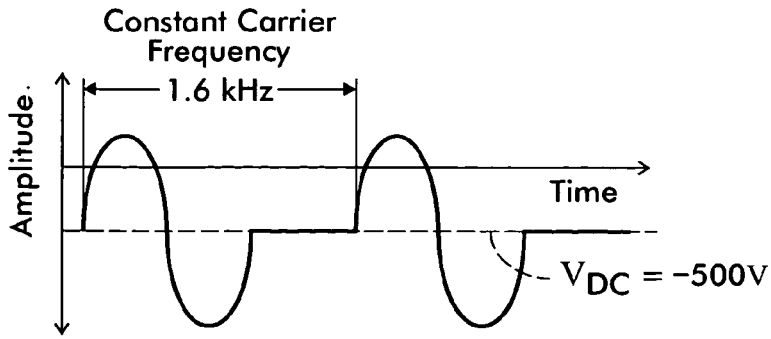
FIG. 4 shows the Vhi-Vpp and Vhi-IAC for conventional and burst modulated BCR charging wherein the AC duty cycle is varied by Method 2.
Figure 4B:
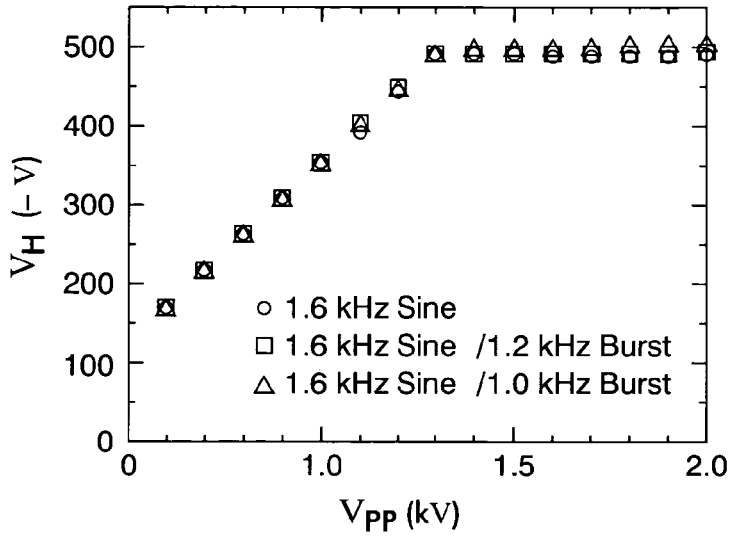
Figure 4C:
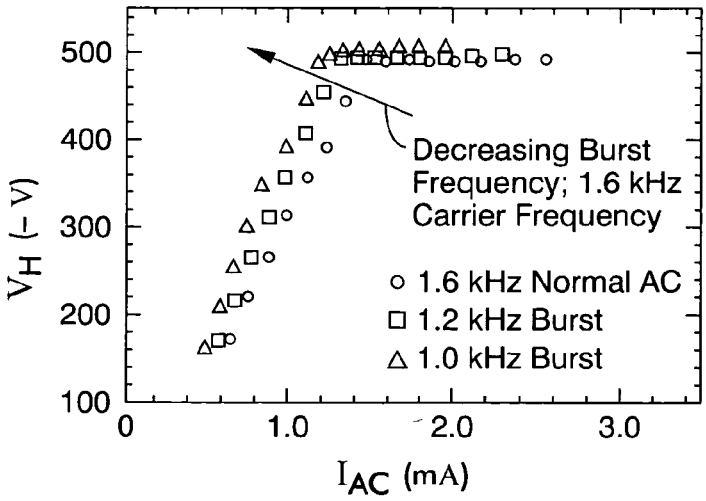

FIG. 3 shows the charging results for varying the AC duty cycle by Method 2. Shown for reference in the filled circles in FIGS. 4A and 4B, respectively, are plots of V-hi against V-pp and $I_{AC}$ for conventional AC BCR charging. The open symbols in FIGS. 4A and 4B show the results for burst modulated charging when the carrier frequency F1 is fixed at 1.6 kHz and the burst frequency F2 is decreased from 1.3 to 1.0 kHz (duty cycle decreased from 80% to 63%). Again at high duty cycle the charging characteristics of the burst modulation approach that of the conventional sine BCR charging. However, at a carrier frequency F1=1.6 kHz, the BCR is not relaxation time limited, so increasing the burst frequency has no effect on the V-hi-Vpp charging curve and in fact a beneficial effect on the V-hi-IAC charging curve is observed insofar as V-th is reduced.

Figure 5:
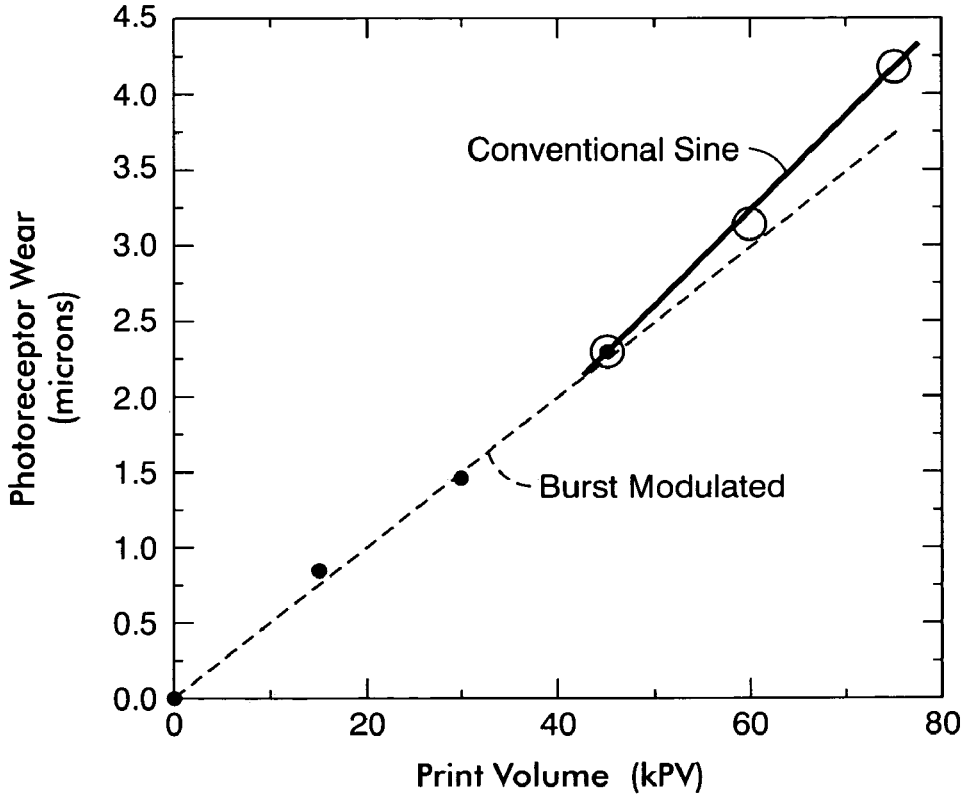
FIG. 5 shows the wear results for conventional and burst modulated BCR charging obtained from print runs in a DC12 machine.

FIG. 5 shows the wear results for conventional and burst modulated BCR charging obtained from print runs in a Docucolor 12 machine produced by Xerox. Common conditions for both tests are as follows. A BCR was mounted with a ca. 900 gram normal force in a BCR holder retrofitted into a the machine In the area normally occupied by the wire scorotron. Standard color toner and developer were used. The normal cleaning blade is mounted with the standard interference (1.1 mm) and blade set angle (22 degrees). The same drum photoreceptor was used in both tests. All tests were conducted in lab ambient, i.e., 68–70° F. and 30–50% RH.

The waveform parameters used in conventional AC sine BCR charging wear test are F=1.6 kHz, Vdc=−570 V and Vpp=2.0 kV. This results in an AC current of 3.5 mA. The waveform for the corresponding burst modulated BCR charging wear test was F1=1.6 kHz (carrier frequency), F2=1.2 kHz (burst rate) and Vpp=2.0 kV. This results in an $I_{AC}$=3–0 mA. New BCRs were used for each test. Wear tests were conducted at constant Vpp to study the effect of decreased AC current and duty cycle. The wear data are plotted in FIG. 5. The initial part of the curve (dashed line) shows wear data obtained during the burst modulated BCR charging. The second part of the curve exhibiting higher slope is the wear data obtained by conventional AC sine BCR charging. Wear rates of 51 nm/kprint and 63 nm/kprint are calculated for burst modulated and normal sine BCR charging, respectively, or a wear rate improvement of 23% with the burst modulated waveform. It is reasonably expected that decreasing the duty cycle from the 75% value in the above wear tests to 50% should improve the wear rate even further. Such an anticipated wear improvement would not come at the expense of print quality since as shown below halftone uniformity and background are acceptable at 50% duty cycle. In terms of BCR contamination, no significant differences in the levels of contamination were observed between BCRs used in the burst modulated and conventional AC wear tests above after 3045 kiloprints. This is not surprising as the continuous application of AC even at low duty cycle should be enough to remove charged contamination from the surface.

Print quality was screened as a function of AC duty cycle and in virtually all cases no degradation relative to conventional AC BCR charging was observed in print quality attributes such as halftone uniformity, background and line density. The table in FIG. 6 summarizes the results. Common test conditions include Vdc=−570 V, Vpp=2.0 kV (constant voltage); the photoreceptor was an experimental PTFE filled organic photoconductive. Given a constant burst frequency of 1.6 kHz, variation in carrier frequency from 2.0 to 3:2 kHz (80% and 50% duty cycles, respectively) led to print quality that was equivalent to the control, i.e., conventional AC BCR charging. However, when the carrier frequency was increased to 4.8 kHz (33% duty cycle), print quality was characterized by severe background because the relaxation time limitations of this BCR prohibit attainment of V-hi. Print quality was also generally good with a fixed 1.6 kHz carrier frequency and burst frequency varying from 1.3 to 1.0 kHz (80% and 63% duty cycles, respectively). At 1.6 kHz charging is not limited by BCR relaxation time limitations and burst frequencies lower than 1 kHz are probably useful. The lower limit of burst frequency would be dictated by the onset of banding in the prints. Optimization of carrier and burst frequencies to balance print quality and wear was not done, however, it is clear that the optimized values of the latter should depend on process speed and the electrical properties of the BCR such as relaxation time.

The use of low AC duty cycles is also expected to increase the process speed limit of BCR charging. Burst modulation charging may extend the process speed limit even higher, perhaps as high as 60 ppm particularly if low duty cycles and conductive BCRs are used.

The burst modulation waveform should also be applicable to other types of contact charging members including blade, film, belt, tube, magnetic brush chargers, and the like. Finally, the waveform need not be sinusoidal but can be of any generalized nature such as rectangular or triangular wave.

In recapitulation, there has been provided a charging system wherein unlike clipped or pulsed bias BCR waveforms, burst modulation BCR charging has the desired electrical characteristics of conventional BCR charging, namely, a stable V-hi (independent of Vpp and IAC) and the ability to set V-hi via the DC offset bias. The main advantage of burst modulation BCR charging is that without adversely affecting print quality photoreceptor wear is decreased by reducing the AC duty cycle and AC current. Significant wear reductions should be achievable with even lower duty cycle waveforms than tested to date. The technique is fairly insensitive to contamination. Finally burst modulated BCR charging offers the possibility of extending BCR charging to even higher process speeds.

The invention has been described in detail with particular reference to a preferred embodiment thereof, but it will be understood that variations and modifications can be effected within the spirit and scope of the invention as described hereinabove and as defined in the appended claims.

What is claimed is:

1. A method for charging a photoreceptor reduce wear on the photoconductor comprising:

providing a power supply to apply a bias to said bias charging roll; and applying a bias to said bias charging roll, said applying includes applying a burst modulated waveform to said bias charging roll, generating a burst frequency for said burst modulated waveform, said generating includes employing a DC offset from an AC waveform, in which said AC waveform of a first frequency is gated on and off at a second frequency.

2. The method of claim 1, wherein the generating includes fixing a burst rate to constant frequency and varying a carrier frequency.

3. The method of claim 2, wherein the generating includes employing a carrier frequency between 500 and 5000 Hertz.

4. The method of claim 1, wherein the generating includes modifying a waveform selected from the group consisting of sinusoidal, rectangular, and triangular.

5. The method of claim 1, wherein the generating includes employing a burst rate between 250 and 4000.

6. The method of claim 1, wherein the generating includes employing a AC voltage between 1000 Vpp and 3000 Vpp.

7. The method of claim 1, wherein the generating includes employing a duty cycle between 10% and 99%.

8. A method of operating an electrostatographic printing apparatus, the apparatus including a charge-retentive member defining an imaging surface and a charging device for placing a charge on the imaging surface, comprising:

providing a power supply to apply a bias to said bias charging roll; and applying a bias to said bias charging roll, said applying includes applying a burst modulated waveform to said bias charging roll, the applying includes generating a burst frequency for said burst modulated waveform, the generating includes employing a DC offset from an AC waveform, in which said AC waveform of a first frequency is located on and off at a second frequency and fixing a carrier frequency to constant frequency and varying a burst rate.

* * * * *